United States Patent [19]

Greene et al.

[11] Patent Number: 4,745,326

[45] Date of Patent: May 17, 1988

[54] METHOD OF MANUFACTURING INTEGRAL SHADOW GRIDDED CONTROLLED POROSITY, DISPENSER CATHODES

[75] Inventors: Richard F. Greene, Bethesda; Richard E. Thomas, Riverdale, both of Md.

[73] Assignee: The United States of America as represented by the Secretary of the Navy, Washington, D.C.

[21] Appl. No.: 940,121

[22] Filed: Dec. 10, 1986

[51] Int. Cl.[4] ..... H01J 1/14; H01J 9/04

[52] U.S. Cl. ..... 313/346 DC; 313/293; 313/299; 313/345; 313/355; 445/46; 445/51; 427/77

[58] Field of Search ..... 313/346 R, 346 DC, 348, 313/299, 345, 355; 445/46, 50, 51; 29/592 R; 427/77, 78

[56] References Cited

U.S. PATENT DOCUMENTS

| | | | |
|---|---|---|---|
| 3,818,260 | 9/1975 | Elfe, Jr. et al. | 313/299 |
| 3,967,150 | 6/1976 | Lien et al. | 313/338 |
| 4,101,800 | 7/1978 | Thomas et al. | 313/346 DC |
| 4,254,357 | 3/1981 | Haas et al. | 313/268 |
| 4,371,809 | 2/1983 | Thomas et al. | 313/346 DC X |
| 4,379,979 | 4/1983 | Thomas et al. | 313/346 R |
| 4,587,455 | 5/1986 | Falce et al. | 313/346 DC |
| 4,680,500 | 7/1987 | Buck | 313/348 |

*Primary Examiner*—David K. Moore
*Assistant Examiner*—Mark R. Powell
*Attorney, Agent, or Firm*—Thomas E. McDonnell; Brian C. Kelly

[57] ABSTRACT

A controlled porosity dispenser cathode and method of manufacture therefore, using chemical vapor deposition and laser drilling, ion milling, or electron discharge machining for consistent and economical manufacturing a cathode with pores on the order of 0.2 to 2 μm in diameter.

36 Claims, 2 Drawing Sheets

METHOD OF MANUFACTURING INTEGRAL SHADOW GRIDDED CONTROLLED POROSITY, DISPENSER CATHODES

FIELD OF THE INVENTION

This invention relates to cathodes for travelling wave tubes, and more particularly to a controlled porosity dispenser cathode and a method of manufacture therefor.

It is often desirable to create a grid of holes in an emissive material, such as tungsten, such that the holes have a diameter of 0.2 to 2 μm, centers of which are positioned on 10 to 30 μm apart. These holes are drilled in emissive fields of a spherical concave surface with an array of mesas of emissive material capped by an emission-suppressing material (such as zirconium) thereon. The mesas act as an integral shadow grid whose height affects beam optics.

Even with the best laser drilling or present day patterning for ion milling equipment available, the smallest holes achievable, are 5–10 μm.

SUMMARY OF THE INVENTION

The invention encompasses a controlled porosity dispenser (CPD) cathode apparatus including: a support structure of emissive material, a shadow grid of emission limitation mesas integrated with the support structure. The interstices of emissive material between the mesas have arrays of small closely spaces holes.

The invention further discloses a method of manufacturing a CPD cathode by manufacturing a mandrel with an array of triangular slots; coating the mandrel with a material to form support structure; machining the top surface of the overcoated mandrel to leave a support structure embedded in the slots of the mandrel; depositing an emissive material over the mandrel, with its embedded support structure; depositing a refractory emission suppressing material above the emissive layer; machining the deposited layers to leave a shadow grid pattern of emission supporting surfaces and a linking support structure; etching out the mandrel leaving a support structure with the shadow grid integrated with the mesas of emissive material deposited thereon, and thin intersticial areas of emissive material; drilling an array of small holes in the areas of emissive material; and narrowing the diameter of the holes.

It is therefore an object of the invention to economically manufacture controlled porosity dispenser cathodes, and a method of manufacture that allows for accurate optimization of dimensions of an integral shadow and control grid with the use of chemical deposition techniques.

It is therefore an object of the present invention to provide a method of manufacturing controlled porosity dispenser cathodes.

A further object of the invention is a method of producing the required 0.2 to 2 μm holes with the integral shadow grid economically and reproducibly.

DETAILED DESCRIPTION OF THE DRAWINGS

Figure 3:
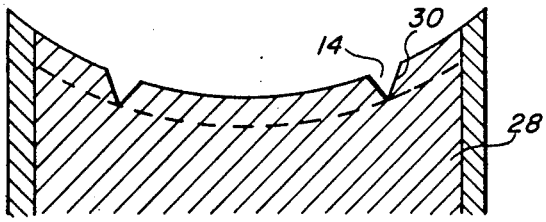
FIG. 3 is a partial cross-sectional view of the invention showing the mandrel after the first machining operation so the structural framework is embedded in the mandrel.
Figure 4:
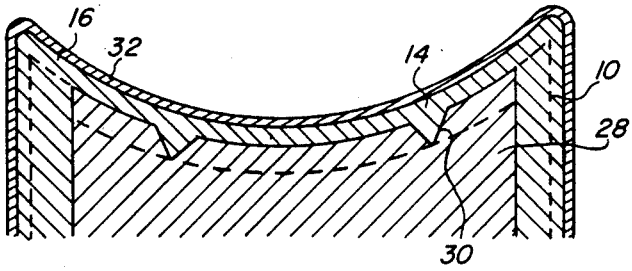
FIG. 4 is a partial cross-sectional view of the invention showing the mandrel after the deposition of the emissive material and the emission suppressing material.

Referring now to the drawings, a method of forming a controlled porosity dispenser cathode is disclosed. A mandrel 28 made of molybdenum, copper or other suitable material, with an axially symmetric pattern of six spokes extending from a center circle to an outer circle 20 of triangular slots oriented similarly to the framework shown in FIG. 1. Mandrel 28 has a curved spherical concave surface which these slots 30 are cut in, or alternately, the mandrel can be cast. Slots 30 have a depth of 50 to 150 μm and a width of 25 to 100 μm at the top as shown in FIG. 3. Mandrel 28 is coated with 50 to 150 μm of tungsten, nickel, or other suitable material 11, by chemical vapor deposition or other suitable means. Coating material 11 on the curved surface of mandrel 28 is machined flush with the mandrel as shown in FIG. 3 by electron discharge machining or other suitable method, leaving the framework embedded in the slots of the mandrel and the outer support structure 10 deposition bonded thereto. Next, 25 to 75 μm of emissive material 16 made of tungsten, tungsten osmium, tungsten rhenium, tungsten iridium, nickel, osmium, rhenium, iridium, or other suitable material or alloy is deposited on the mandrel 28 by chemical vapor deposition, or other suitable method. The chemical vapor deposition of tungsten is carried out pyrolyrically or photolytically using tungsten carbonyl, tungsten hexaflouride, or other suitable substance. Similar CVD processes are used for other metals and alloys. Additionally, 3 to 20 μm of emission suppressing material 32, preferably zirconium, pyrolitic graphite, boron nitride or other suitable refractory material is deposited atop the emissive material by sputter deposition or other suitable method. FIG. 4 shows the two layers deposited on the mandrel.

Figure 5:
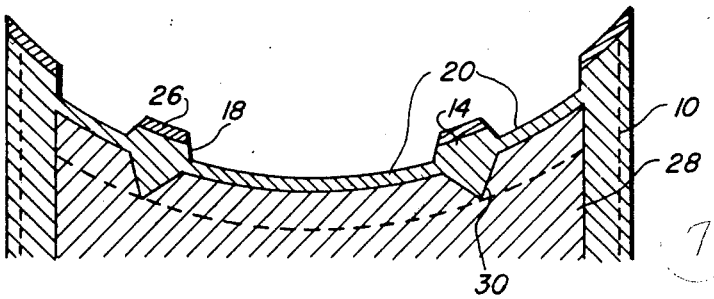
FIG. 5 is a partial cross-sectional view of the invention showing the mandrel after the second machining operation leaving the shadow grid integrally bonded to the support structure and the interstices of emissive material.

FIG. 5 shows the cathode after a portion of the emission suppressing material 32 and underlying emissive material 16 have been cleared to a depth of 10 to 50 μm of emissive material in the field areas 20 whereby mesas 18 are formed. The remaining emission suppressing material caps the mesas 18 of emissive material to form a shadow grid 26 directly above the framework 12 of beams 14.

Figure 1:
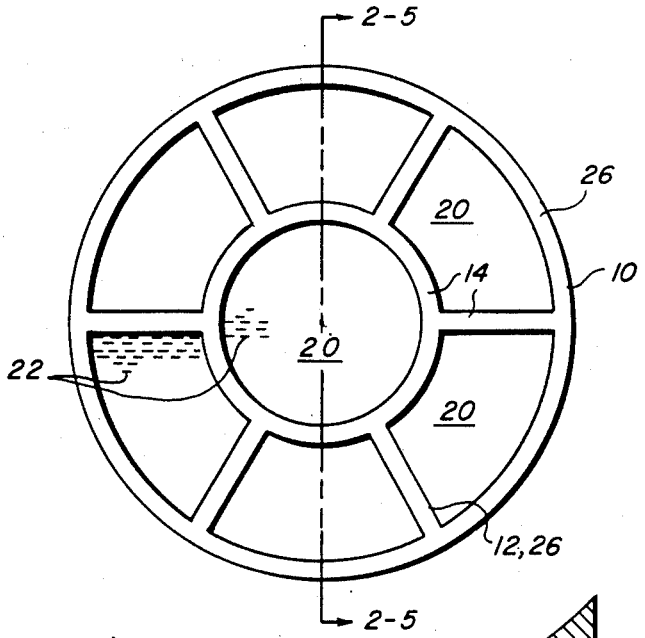
FIG. 1 is a partial top view of the invention showing the shadow grid and emissive surfaces with holes therein.
Figure 2:
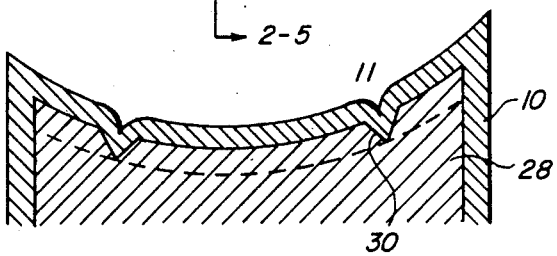
FIG. 2 is a partial cross-sectional view of the invention showing the mandrel with the structural material deposited thereon.
Figure 6:
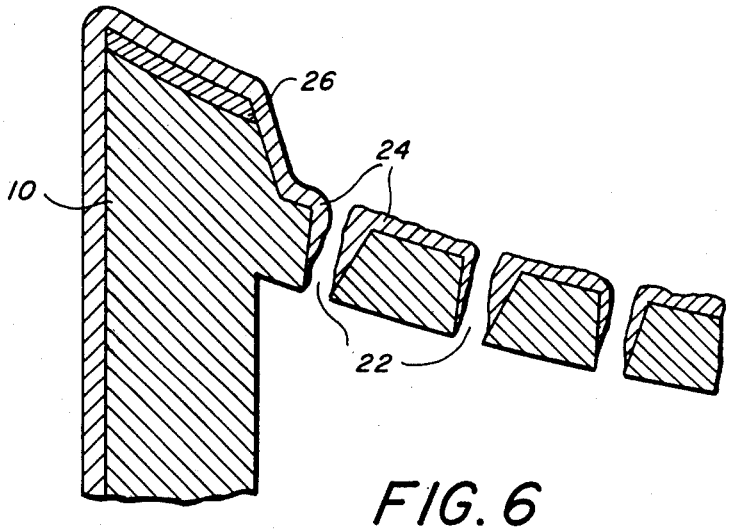
FIG. 6 is a magnified partial cross-sectional view of the invention showing the cathode after the mandrel has been etched out, and the holes have been drilled and overcoated with emission active material to narrow the holes.

The pattern of the completed shadow grid 26 is shown in FIG. 1. It repeats the concentric circle and spoke pattern of the mandrel 8; in addition, the spokes and circles outline fields of emissive material between mesas 18. The clearing of the cathode to form mesas 18 can be the result of electron discharge machining, ion milling, photolithography with wet etching or other suitable method. The mandrel 28 is etched away by a suitable method. Arrays or slots 22 are formed in the emissive fields 20 as shown in FIG. 1. The holes can be formed by laser drilling, ion milling, or other suitable process. Since these processes leave the holes or slots 22 somewhat too wide (approximately 10 μm, the desired width being 0.2 to 2.0 μm), diameters are narrowed as shown in FIG. 6 by overcoating the cathode with 3 to 5 μm of an emission active material; tungsten, tungsten osmium, tungsten rhenium, osmium, rhenium, iridium or other suitable material.

Figure 7:
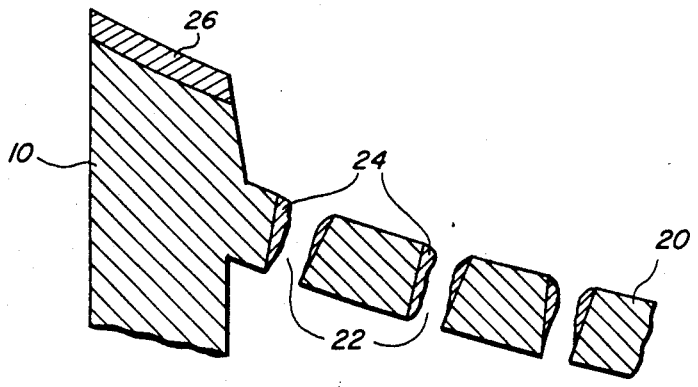
FIG. 7 is a magnified partial cross-sectional view of the invention showing the finished cathode with the overcoat removed from the surfaces of the shadow grid and the emissive area, however, a small amount remains in the holes thus narrowing their diameter.

The overcoat 24 is removed from the emissive field 20 and the shadow grid 26 by planar plasma etching or other suitable method. Because the ion bombardment is at normal incidence, the overcoat 24 will not be significantly removed from the holes or slots 22 as shown in FIG. 7.

In another embodiment, the overcoat 24 is machined off the shadow grid but allowed to remain on the emissive field areas 20. This would be common where emission enhancers, such as rhenium, osmium, indium or some other suitable material, are used.

The invention also encompasses a controlled porosity dispenser thermionic cathode with an integral shadow grid 26 including cylindrical outer support structure 10 made of tungsten, nickel or other suitable material or alloy having a thickness of 25 to 150 μm. The outer support structure 10 is deposition bonded to the support framework 12 under the shadow grid 26 as shown in FIGS. 1 and 5. The shadow grid 26 and deposition bonded and support framework 120 are spherical concave surfaces patterned as six or more spokes symmetrically linking an inner circle with a coaxial outer circle. The shadow grid outlines emissive fields 16 which have arrays of holes or slots 22 therein. Each hole or slot 22 has a measure of overcoating 24 to narrow the diameter of the hole or slot 22.

The support framework 12 is made up of triangular beams shown partially in FIGS. 1–5, the beams being 50 to 150 μm deep and 25 to 125 μm wide at the top as shown in FIG. 3 and made of the same material as the outer support structure 10. The emissive material, as aforementioned, is deposition bonded to the support framework. The emissive field 20 made of the aforementioned material, has a thickness 10 to 50 μm with arrays of holes or slots 0.2 to 2 μm in diameter with centers 10 to 40 μm apart. The shadow grid 26 has, 3 to 20 μm of the previously described emission suppressing material capping 10 to 70 μm mesa areas 18 of emissive material deposition bonded to the support framework 12. The emission suppressing material is deposition bonded to the mesas 18.

Mandrel 28 can be etched out after the holes or slots 22 are formed.

The size and arrangement of the holes and the configuration of the shadow grid can be adjusted to optimize beam characteristics.

The overcoating material 24 can be machined off the emission suppressing of the shadow grid 26 by electron, discharge machining using a smooth electrode.

There has been disclosed a controlled porosity cathode and a method of manufacture therefore. Obviously, many changes and modifications are possible in light of the above teachings. It is therefore to be understood that within the scope of the appended claims the invention may be practiced other than as specifically described.

What is claimed and desired to be secured by Letters Patent of the United States is:

1. A controlled porosity dispenser cathode apparatus comprising:

an integral support structure bounding emissive fields of said cathode apparatus, said support structure comprising emissive material; and a shadow grid comprising a pattern of emissive limitation means bonded to said support structure for increased laminarity of a cathode beam;

wherein said emissive fields have multiple closely spaced holes between said emission limitation means for improving beam optics.

2. A cathode as received in claim 1 wherein said support structure has a curved surface and said emission limitation means comprise a shadow grid of capping surfaces of an emission supressing material integrated a top mesas of emissive material which are slightly raised above said curved surface of said support structure for adjusting said cathode beam.

3. A cathode as recited in claim 1 wherein said shadow grid and said support structure comprise parallel spherically concave surfaces.

4. A cathode as recited in claim 1 wherein; said pattern of emission limitation means comprises a radially symmetrical pattern of spokes connecting concentric circles.

5. An apparatus as recited in claim 1 wherein said emissive material is selected from the group consisting of tungsten, tungsten osmium, tungsten rhenium and nickel.

6. An apparatus as recited in claim 1 wherein said emissions supressing material comprises a refractory material selected from the group consisting of zirconium, pyrolitic graphite, and boron nitride.

7. An apparatus as recited in claim 1 where said emission suppressing material surfaces comprise caps integrated atop mesas of emissive material raised 50 to 150 μm above the curved surface of said support structure.

8. An apparatus as recited in claim 2 wherein said capping surfaces comprise a thickness of 3 to 20 μm of refractory material.

9. An apparatus as recited in claim 1 wherein said holes are 1 to 8 μm in diameter on 10 to 50 μm centers.

10. A method for manufacturing a controlled porosity dispenser thermionic cathode which comprises the steps of:

manufacturing a pattern of triangular slots into a mandrel face;

coating said mandrel face with a support material to form a support structure;

machining said support material flush with said mandrel face to leave said support structure embedded in said mandrel face;

depositing an emissive material uniformly over said mandrel face;

depositing an emission suppressing material uniformly over said mandrel face;

machining said deposited materials leaving a shadow grid of emission suppressing surfaces and a linking support structure;

etching out said mandrel face;

drilling an array of holes in the emissive material fields between said emission suppressing surfaces; and narrowing said holes' diameter.

11. A method as recited in claim 10 wherein said pattern of triangular slots of said mandrel are arranged on a spherical concave area of said mandrel.

12. A method as recited in claim 10 wherein said mandrel comprises a material selected from the group consisting of copper and molybdenum.

13. A method as recited in claim 10 wherein said triangular slots are 75 to 125 μm deep.

14. A method as recited in claim 10 wherein said triangular slots are 50 to 75 m wide at the top.

15. A method as recited in claim 10 wherein said step of overcoating said mandrel is carried out by chemical vapor deposition means.

16. A method as recited in claim 15 wherein said support material is overcoated to a thickness of 75 to 125 μm.

17. A method as recited in claim 10 wherein said steps of machining are carried out by electron discharge machining means.

18. A method as recited in claim 15 wherein said step of depositing said emissive material is carried out by chemical vapor deposition means.

19. A method as recited in claim 18 wherein in the case of depositing tungsten, further comprising a deposition material selected from the group of Tungsten Carbonyl or Tungsten Hexaflouride.

20. A method as recited in claim 10 wherein said step of depositing of emission suppressing material is carried out by sputter deposition means.

21. A method as recited in claim 10 wherein said emissive material is deposited to a thickness of 15 to 75 μm.

22. A method as recited in claim 10 wherein said emission suppressing material is deposited to a thickness of 5 to 15 μm.

23. A method as recited in claim 10 wherein said step of machining is carried out by election discharge machining means.

24. A method as recited in claim 10 wherein said step of machining is carried out by ion milling means.

25. A method as recited in claim 10 wherein said step of machining is carried out by photolithography means in concert with wet etching means.

26. A method as recited in claim 10 wherein said step of machining cuts away emission suppressing material to expose the underlying emissive material and leave a shadow grid of refractory material capped mesas on a curved surface of emissive material.

27. A method as recited in claim 10 wherein said step of machining leaves a thickness of 10 to 50 μm of said emissive material.

28. A method as recited in claim 10 wherein said step of drilling is carried out by ion milling means.

29. A method as recited in claim 10 wherein said step of drilling is carried out by laser drilling means.

30. A method as recited in claim 10 wherein said step of drilling results in an array of holes on 10 to 30 μm centers.

31. A method as recited in claim 10 wherein said step of narrowing said holes is carried out by overcoating said shadow grid structure with an emissive material.

32. A method as recited in claim 31 wherein said step of narrowing said holes further comprises removing said overcoating from the emitting surface and shadow grid by removal means.

33. A method as recited in claim 32 wherein said removal means comprises planar plasma etching.

34. A method as recited in claim 32 wherein said removal means comprises electron discharge machining using a smooth electrode surface.

35. A method as recited in claim 10 wherein said step of narrowing leaves said holes with a diameter of 0.2 to 2 μm.

36. A method as recited in claim 31 wherein said overcoating is carried out to a depth of 3 to 5 μm.

* * * * *